US005258702A

United States Patent [19]

Conzelmann et al.

[11] Patent Number: 5,258,702

[45] Date of Patent: Nov. 2, 1993

[54] PRECISION REFERENCE VOLTAGE SOURCE

[75] Inventors: Gerhard Conzelmann, Leinfelden-Oberaichen; Karl Nagel, Gomaringen; Gerhard Fiedler, Neckartailfingen; Andreas Junger, Reutlingen, all of Fed. Rep. of Germany

[73] Assignee: Robert Bosch GmbH, Stuttgart, Fed. Rep. of Germany

[21] Appl. No.: 768,283

[22] PCT Filed: Mar. 21, 1990

[86] PCT No.: PCT/DE90/00212

§ 371 Date: Oct. 1, 1991

§ 102(e) Date: Oct. 1, 1991

[87] PCT Pub. No.: WO90/12351

PCT Pub. Date: Oct. 18, 1990

[30] Foreign Application Priority Data

Apr. 1, 1989 [DE] Fed. Rep. of Germany ..... 3910511
Feb. 23, 1990 [DE] Fed. Rep. of Germany ..... 4005756

[51] Int. Cl.[5] ..... G05F 3/22

[52] U.S. Cl. ..... 323/313; 323/315; 307/296.1; 307/296.6

[58] Field of Search ..... 323/313, 314, 315, 907; 307/296.1, 296.6

[56] References Cited

U.S. PATENT DOCUMENTS

| | | | |
|---|---|---|---|
| 4,242,693 | 12/1980 | Biran | 357/28 |
| 4,250,445 | 2/1981 | Brokaw | 323/313 |
| 4,362,984 | 12/1982 | Holland | 323/313 |
| 4,443,753 | 4/1984 | McGlinchey | 323/313 |
| 4,490,670 | 12/1984 | Wong | 323/313 |
| 4,797,577 | 1/1989 | Hing | 307/297 |
| 4,808,908 | 2/1989 | Lewis | 323/313 |
| 4,939,442 | 7/1990 | Carvajal et al. | 323/314 X |
| 5,053,640 | 10/1991 | Yum | 323/313 X |

OTHER PUBLICATIONS

Yannis P. Tsividis, "Accurate Analysis of Temperature Effects in $I_C$-$V_{BE}$ Characteristics with Application to Bandgap Reference Sources," IEEE Journal of Solid-State Circuits, vol. SC-15, 1π6, pp. 1076-1084 (Dec. 1980).

A. B. Grebene, "Bipolar and MOS Analog Integrated Circuit Design" section 3.9—Trimming of Resistors, pp. 155-159, (John Wiley & Sons, New York, 1984).

A. Paul Brokaw, "A Simple Three-Terminal IC Bandgap Reference" *IEEE Journal of Solid-State Circuits*, vol. SC-9, No. 6, pp. 388-393 (Dec. 1974).

Gerard C. M. Meijer, et al., "A New Curvature-Corrected Bandgap Reference", *IEEE Journal of Solid-State Circuits*, vol. SC-17, No. 6, pp. 1139-1143 (Dec. 1982).

Bang-Sup Song et al., "A Precision Curvature-Compensated CMOS Bandgap Reference", *IEEE Journal of Solid-State Circuits*, vol. SC-18, No. 6, pp. 634-643 (Dec. 1983).

Marc Degrauwe et al., "A Family of CMOS Compatible Bandgap Refrences", 8172 *IEEE International Solid-State Conference*, Coral Gables, Fla, Feb. 1985, pp. 142, 143, 326 +FIGS. 1-4.

*Primary Examiner*—Emanuel T. Voeltz
*Attorney, Agent, or Firm*—Frishauf, Holtz, Goodman & Woodward

[57] ABSTRACT

A monolithically integrated precision reference voltage source by the bandgap principle, suitable for a wide temperature range, is proposed, in which the parabolic course of the temperature response curve of the reference voltage is linearized by process means available in the monolithic integration, dispensing with additional active components such as transistors or diodes. The precision voltage reference source includes two resistors (21, 22), which are represented by the N-doped emitter diffusion zone.

12 Claims, 4 Drawing Sheets

PRECISION REFERENCE VOLTAGE SOURCE

BACKGROUND OF THE INVENTION

The invention relates to a precision reference voltage source as generically defined by the preamble to the main claim.

Increasingly stringent demands are made in terms of the characterizing data of monolithically integrated circuits for the motor vehicle. Because of the wide temperature range from $-40°$ C.$\leqq$Tj$\leqq+150°$ C. and above, reference voltage sources with an extremely small or definedly predeterminable temperature coefficient (TK) and low piezoelectric sensitivity are especially important.

From the article by G. C. M. Meijer, P. C. Schmale and K. van Zalinge, "A New Curvature-Corrected Bandgap Reference" in IEEE Journal of Solid-State Circuits, Vol. SC-17, No. 6, Dec. 1982, A precision reference voltage source of the generic type of the main claim is already known; it contains 47 components on a chip area of 4 $mm^2$ and requires an IC manufacturing process using nickel-chromium resistor technology. Its temperature coefficient is given as 50 ppm in a temperature range of 25° C.$\leqq$Tj$\leqq$85° C.

The article by A. P. Brokaw, "A Simple Three-Terminal IC Bandgap-Reference" in IEEE Journal of Solid-State Circuits, Vol. SC-9, No. 6, December 1974, already discloses a monolithically integrated reference voltage source operating by the bandgap principle, which includes 29 components on a chip area of 1.47 $mm^2$ and is likewise produced by nickel-chromium resistor technology. Its temperature coefficient is given as 5 to 60 ppm for a temperature range from $-55°$ C.$\leqq$Tj$\leqq$125° C.

ADVANTAGES OF THE INVENTION

The precision reference voltage source according to the invention, as defined by the body of the main claim, has the advantage over the prior art that in it, the approximately parabolic course of the temperature coefficient of the bandgap reference is linearized by simple provisions, contrary to the known versions with complicated circuitry, and that its piezoelectric sensitivity is lowered.

The temperature coefficient of the bandgap voltage of silicon includes higher order terms (Tsividis, Y. P.: "Accurate Analysis of Temperature Effects in $I_C$-$V_{BE}$ Characteristics with Application to Bandgap Reference Sources", IEEE Journal of Solid-State Circuits, Vol. SC-15, No. 6, December 1980).

The following zones are available for the monolithically integrated circuit: substrate (P−), isolation diffusion (P-P+), epitaxial (N−), buried-layer diffusion (N+), deep-collector diffusion (N+) base diffusion (P), emitter diffusion (N+), metallizing, and possibly other zones, such as doped polysilicon or chromium/nickel resistors (for fused links); other zones may also be present, dictated by the process, examples being an upper and lower isolation diffusion zone or a base-connection diffusion zone.

If one considers the temperature coefficients of the specific or areal resistors $$R(\Delta T)=R_{To}[1+\alpha(\Delta T)+\beta(\Delta T)^2+\gamma(\Delta T)^3]$$

of these zones, then there are some with a (virtually linear temperature coefficient, such as the N+-doped or metallized zones, and others with a more or less high proportion of higher order terms, such as the P-doped ones. There are also zones with a more or less piezoelectric sensitivity.

The subject of the invention is based on the intent to linearize an approximately parabolic temperature course of the bandgap voltage further compared with what is known, or to compensate for it by means of a resistor having a temperature coefficient likewise having a proportion of higher order terms. Adequately good compensation can already be attained by taking the quadratic term into account. Since there are zones with a large quadratic term and zones with a small one, the correct value can be attained by means of a suitable combination of at least two different zones. As a result, compared with the prior art, there is not only a drastic simplification of circuitry and technology, but associated with it also a considerably smaller chip area. This latter feature is especially important:

Since the temperature coefficients, at 5 to 50 ppm, given for the above examples, with their compensation which although expensive because of the additional components is theoretically good, are still relatively too high, they are brought about by other effects, such as the piezoelectric sensitivity of their components as a consequence of temperature-dependent mechanical stresses (on this point, see G. C. M. Meijer: "Integrated Circuits and Components for Bandgap References and Temperature Transducers", Dissertation, Technical University of Delft, March 18, 1982, 18). Circuits that require less chip area are intrinsically easier to master, especially whenever in accordance with the invention fewer piezoelectrically sensitive zones are used to represent critical resistors and compensation methods are furthermore employed in the layout.

DRAWING

The invention will now be described in conjunction with FIGS. 1–11.

Figure 8:
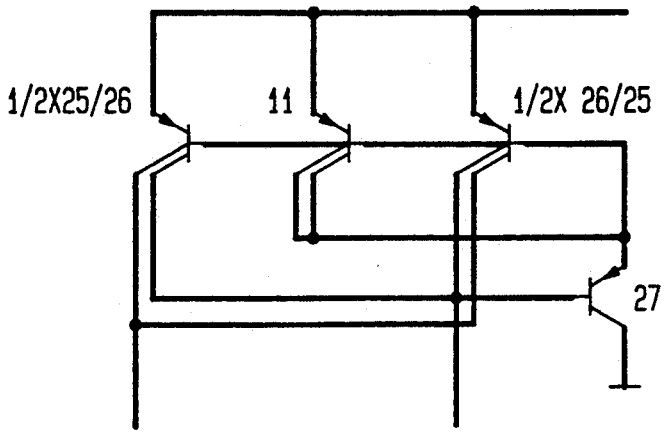
Figure 9:
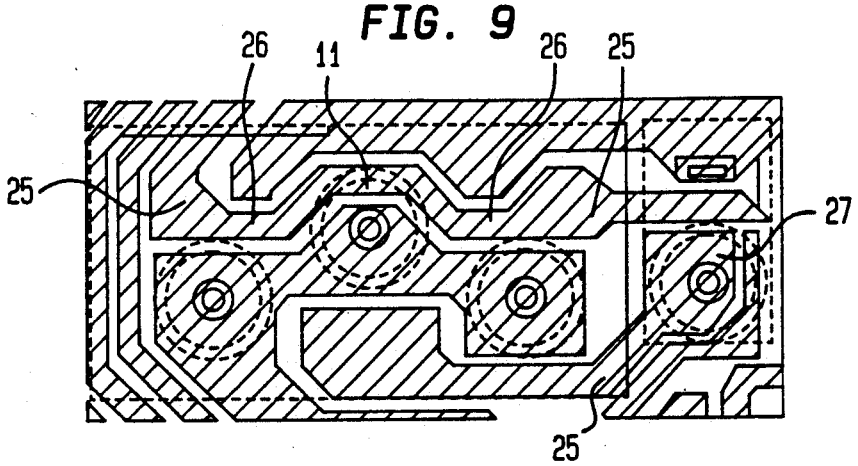
Figure 10:
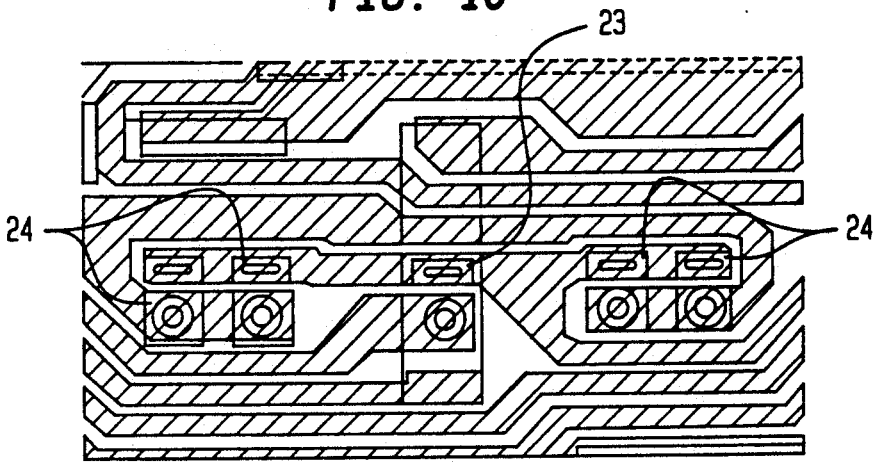
Figure 11:
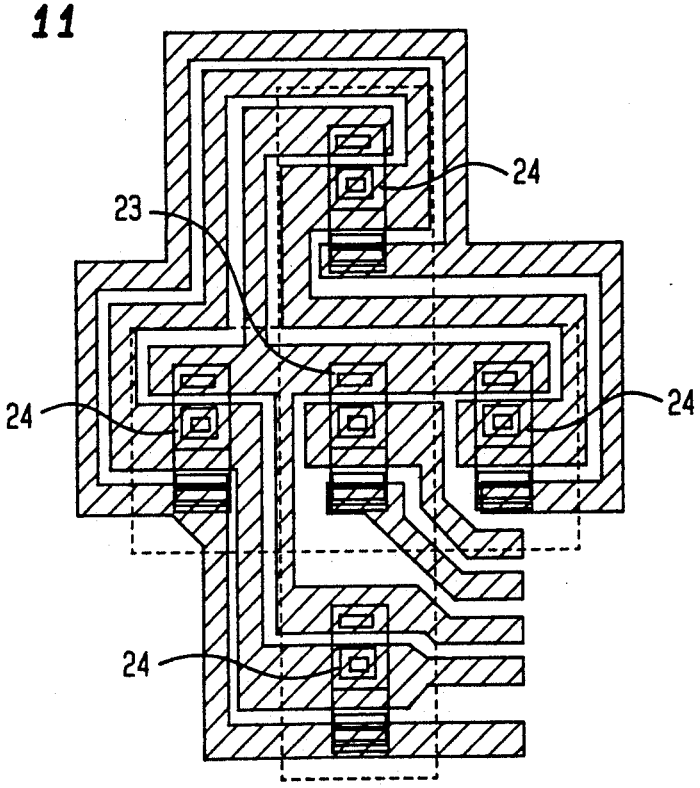

In FIG. 8, the circuit and in FIG. 9 the layout of cross-coupled lateral transistors for reducing their piezoelectric sensitivity are shown, and in FIGS. 10 and 11 the arrangement is shown in the layout for the critical NPN reference transistors.

DESCRIPTION OF THE EXEMPLARY EMBODIMENTS

Figure 1:
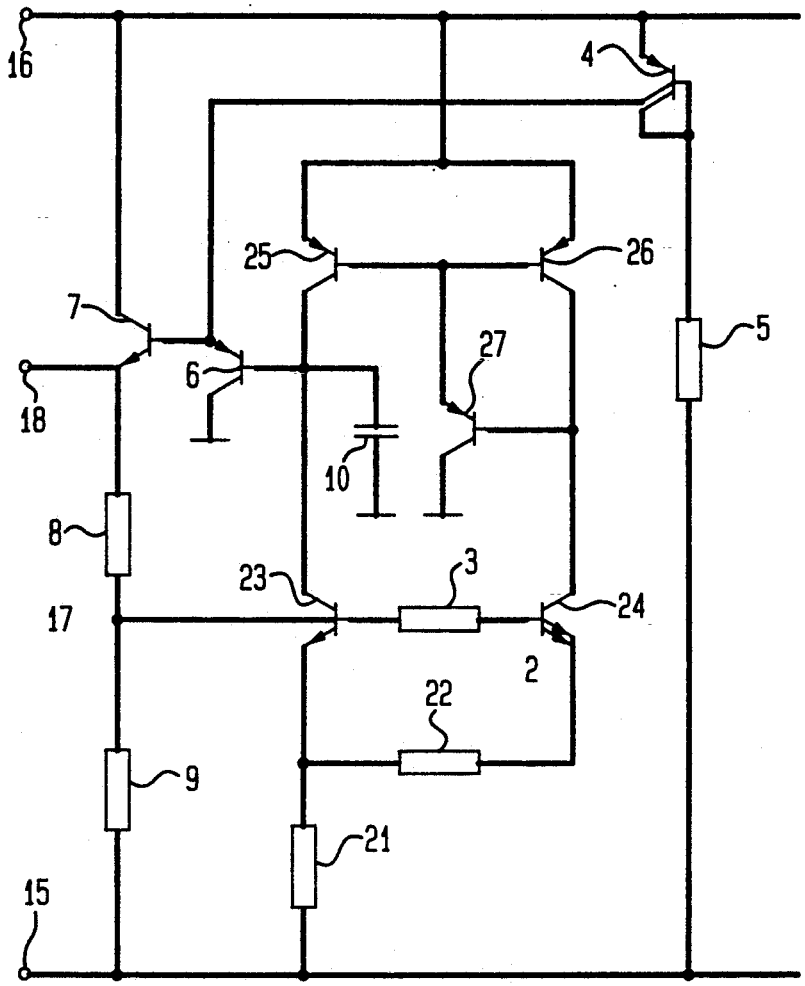
FIG. 1 (PRIOR ART)
FIG. 1 shows the basic circuit of a bandgap reference in accordance with Brokaw, expanded by a startup circuit.

The bandgap reference of FIG. 1 comprises the two reference transistors 23 and 24; as a rule, the transistor 24 is produced by the parallel connection of K identical transistors 23, where $2\leqq K\leqq 16$. Because of the formal dependency of 1 nk, K=4 is already adequate, and K above 8 is hardly ever used. Together with the resistors 22, the arrangement generates a temperature-proportional voltage at the resistor 21 that already compensates quite well for the negative temperature response curve of the base-to-emitter voltage of the transistor 23, given a correct layout. The potential difference 17/15 represents the summation voltage. It is quite accurately equivalent to the potential of the bandgap (of silicon).

The two reference transistors 23, 24 act as a current mirror having the two lateral PNP transistors 25, 26, the common base of which is located at the collector 24, via the PNP emitter follower 27. Decoupling from the collector of the transistor 23 is correspondingly done with the PNP emitter follower 6, the emitter of the transistor being connected to the base of the NPN emitter follower 7. In order to obtain even higher voltages as the bandgap voltage, the emitter of the transistor 7 is not connected to the point 17 directly, but rather to the point 17 via the resistor 8. The reference voltage that can be picked up at the terminal 18 is thus higher, as a function of the transformation ratio of the resistors 8, 9. The transistors 25, 26, 27, 6, 7 form an operational amplifier, which is dynamically stabilized by means of the capacitor 10. The transistor 4 and resistor 5, likewise acting as a current mirror, furnishes an adequately low "startup current" to the circuit. The positive pole of the operating voltage is connected to the terminal 16, and its negative pole is connected to the terminal 15.

Figure 2:
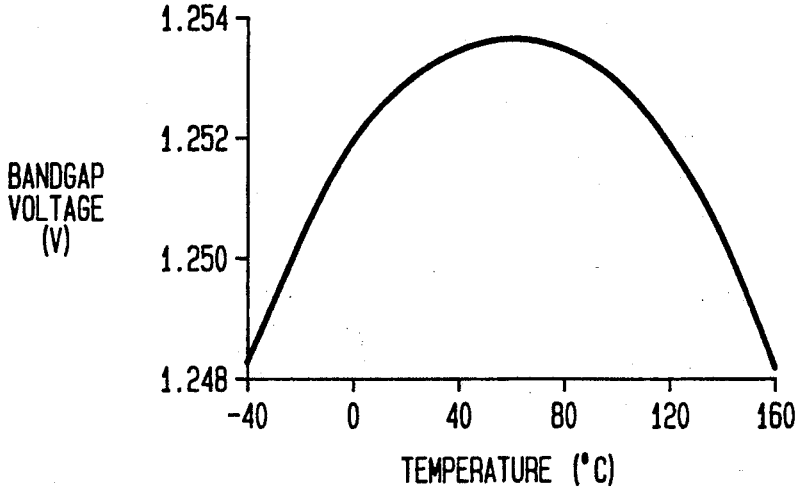
FIG. 2 (PRIOR ART)
FIGS. 2–4 show the temperature response curves of the reference voltages of an exemplary circuit for resistors with three different temperature coefficients in the temperature range of $-40°\leqq$Tj$\leqq+160°$ C.

The temperature course of the reference voltage of an example in the circuit of FIG. 1 is shown in FIG. 2. There, the bandgap voltage is shown as a function of the temperature between −40° C. and +160° C., for a version in which the horizontal tangent is located in the middle of the temperature range, and in the typical manner for simple references, the resistors 21 and 22 are represented by means of the base diffusion. It can be seen that the reference voltage has a rather parabolic temperature course, which is known to be dependent on the manufacturing process or in other words on the doping and doping profiles, and thus in other versions can also include higher order terms. At the two limit temperatures of the range, the deviation amounts to somewhat more than −5 mV, corresponding to a mean temperature coefficient of −4%.

Figure 3:
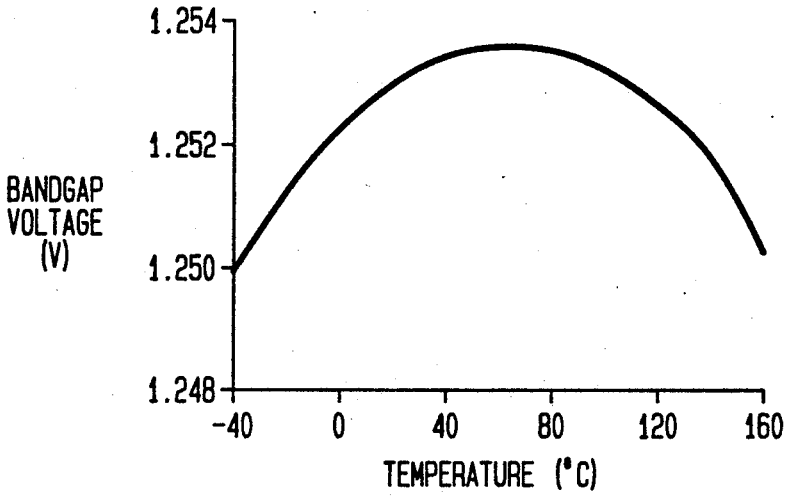
Figure 4:
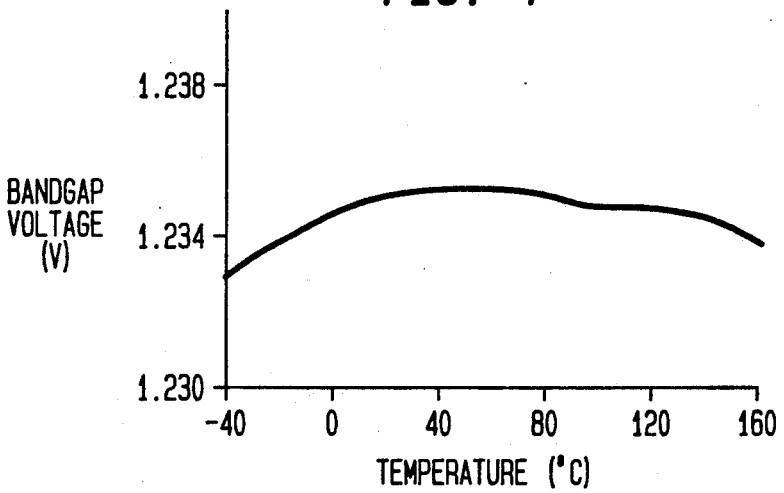

In this example, the temperature response curve can already be markedly improved by using the emitter diffusion instead of the base diffusion for the resistors 21, 22, as FIG. 3 shows. If furthermore, in our example—purely theoretically—the resistors 21 and 22 are provided with the temperature coefficient "0", then the calculation reproduced in FIG. 4 still exhibits a deviation of approximately −2.3 mV, with higher order components.

This steadily approximately parabolic course can now be compensated for by providing that in FIG. 1 the resistor 21 is assigned a temperature component having higher proportions of higher order terms than the resistor 22.

Figure 5:
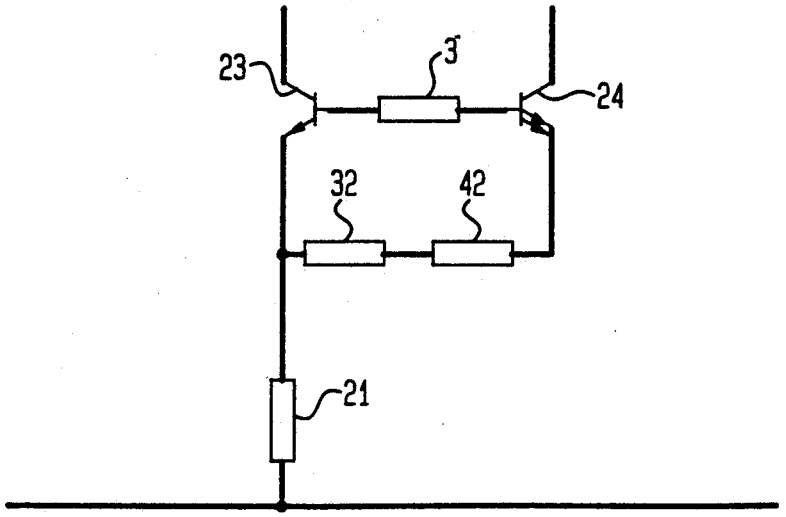
FIGS. 5 and 6 show modifications according to the invention of the circuit of FIG. 1.
Figure 7:
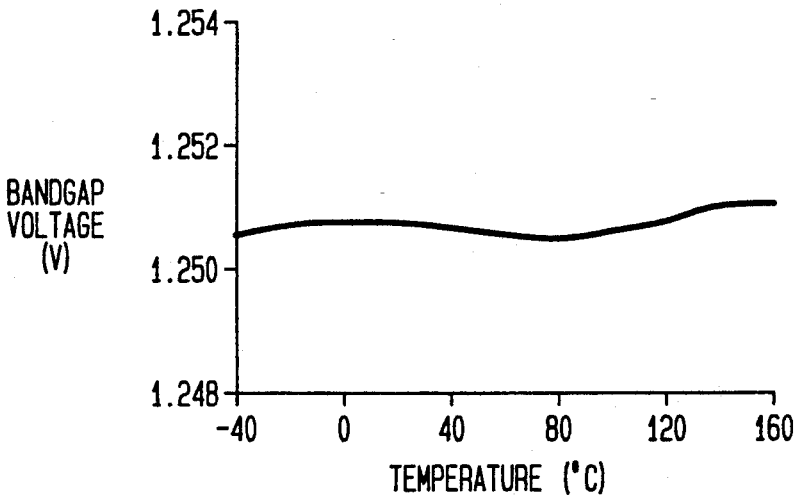
FIG. 7 shows the resultant temperature response curve of the reference voltage.

FIG. 5 shows a modification according to the invention of the circuit, for a version of the resistors having a zone of the process that contains a larger quadratic term $\beta_{21}$. Since $\beta_{22}$ must now always be smaller than $\beta_{21}$, in this case the resistor 22 must be split into at least two subresistors 32, 42, and a zone with a lower $\beta$ must be used for the compensation resistor 42. Adequately good compensation for this example is attained if the difference between the coefficients of the quadratic terms $\beta_{21}$ and $\beta^{22}$ is $0.74 \cdot 10^{-6}$. If the resistors 21, 32 are embodied by means of the base diffusion and the resistor 42 is embodied by means of the emitter diffusion, then the result is the temperature course of FIG. 7, with 3435 Ω for the resistor 21, 393 Ω for the resistor 32, and 60 Ω for the resistor 42.

Figure 6:
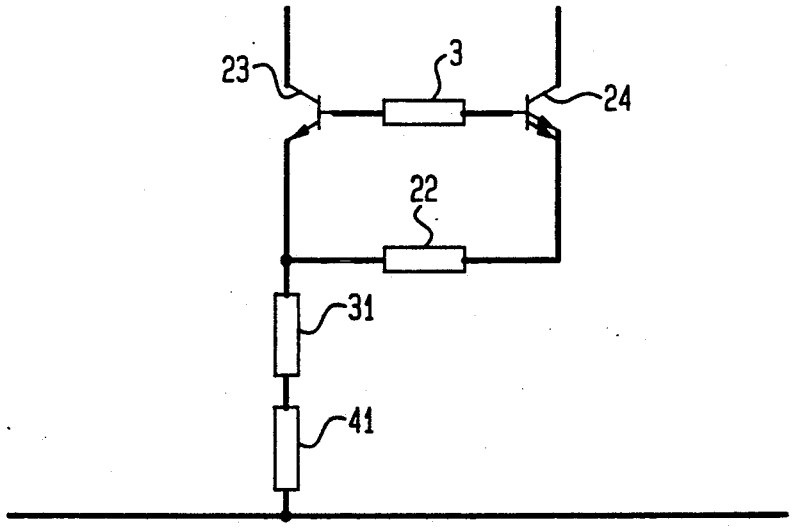

As already noted, the resistors should be formed with zones that have the lowest possible piezoelectric effect, such as the emitter diffusion or other more highly N-doped zones. In that case, the temperature coefficient of the quadratic resistor has practically no higher order terms. The way of achieving this is shown in FIG. 6. In order that the resistor 21 can be represented with a higher quadratic proportion than the resistor 22, it must be split into the subresistors 31 and 41, and the compensation resistor 41 must be embodied by means of a zone having a larger quadratic term. The difference $\beta_{21}-\beta_{22}$ should now be $0.49 \cdot 10^{-6}$. If the emitter diffusion zone includes no higher order terms, and if the base diffusion used for the compensation resistor 41 has the same quadratic term as in the previous example, then the resistance of resistor 31 becomes 3135 Ω and of resistor 22 becomes 453 Ω; the correction in base diffusion 41 becomes 300 Ω. The course of the temperature response curve again matches that of FIG. 7.

If process-dictated deviations are taken into account for compensating for the quadratic term of the reference voltage, then the difference in the resultant quadratic terms upon compensation in the resistor 22 by means of the resistor 42 is in the range of $0.3 \cdot 10^{-6} \leqq \beta_{21}-\beta^{22} \leqq 1.2 \cdot 10^{-6}$. Contrarily, if compensation is done in the resistor 21 by means of the resistor 41, then the range should be $0.2 \cdot 10^{-6} \leqq \beta^{21}\beta^{22} \leqq 0.8 \cdot 10^{-6}$.

The resultant terms $\beta_{21}$ and $\beta/_{22}$ can be calculated from the known terms for the zones used for the resistors. For compensation in the region of the resistor 21, the following equation is generally true:

$$\beta_{21}=(\beta_{31} \cdot R_{31}+\beta_{41} \cdot R_{41}) \cdot (R_{31}+R_{41})^{-1}$$

And for compensation in the region of the resistor 22, the following equation applies:

$$\beta_{22}=(\beta_{32} \cdot R_{32}+\beta_{42} \cdot R_{42}) \cdot (R_{32}+R_{42})^{-1}$$

If higher order terms also occur in the temperature response curve of the reference voltage, as can be seen from the literature, then it is advantageous to take them into account as well.

Resistors having differing temperature coefficients can also be represented by a modulation of the width of the resistors in the design, because of the variably large proportion of lateral subdiffusion in the overall resistor, especially since only slight differences in the quadratic term, or a third order term, needs to be produced. Observation has shown that third order terms appear to occur with especially narrow resistors. Because of the general dependency of the temperature coefficient on the manufacturing process, no specific figures on this point can be given.

The compensation figures given cannot be adhered to somewhat exactly unless the actual value for the maximum bandgap voltage also occurs at the temperature on which the calculation has been based. It is accordingly advantageous to calibrate for this maximum.

In the versions proposed, the resistors 21 and 22 are represented by more than one zone. This means that variable process deviation or in other words deviation in resistance must also be expected, resulting in deviation in the divider ratio. In a precision reference voltage source, the divider ratio must be calibrated for a command value, by varying the compensation resistor 41 or 42. Methods for calibrating resistor networks in wafer samples are described in A. B. Grebene: "Bipolar and MOS Analog Integrated Circuit Design", John Wiley & Sons, 1984, pp. 155–159, and are not the subject of the invention.

Although the precision reference voltage source according to the invention requires a chip area of only approximately 0.3 $mm^2$, despite the presence of resistors 31 and 32 represented by means of the relatively low-impedance emitter diffusion including a four-stage calibration network, it is advantageous to make provisions to reduce the piezoelectric sensitivity. The collectors of the two PNP lateral transistors 25 and 26 are therefore split each into two identical subcollectors and connected crosswise with one another, as in the circuit of FIG. 8. A further transistor 11 is introduced between the transistors 25 and 26 to divert any possible base currents, so as to attain higher operating temperatures.

One possible layout for this is shown in FIG. 9. The NPN reference transistors 23 and 24 are also disposed symmetrically with respect to one another, specifically for an emitter ratio of 1:2 and 1:4 in FIG. 10 and for an emitter ratio of 1:4 and 1:8 in FIG. 11. In the latter figures, only four subtransistors 24 are shown. By filling up the free spaces with a further four subtransistors, the approximately piezoelectrically compensated ratio of 1:8 can easily be attained. Wiring is no problem even with eight subtransistors 24 disposed around the transistor 23, because the eight subtransistors can be accommodated in a single collector tub.

Accurate manufacture of precision reference voltage sources by the methods of the past, is virtually impossible even using expensive technologies, so as a rule such sources are expensive types especially selected from a larger production batch. By comparison, by the proposals of the invention they can be produced accurately using standard technologies. They require hardly more surface area than conventional reference voltage sources.

We claim:

1. A monolithically integrated precision reference voltage source operating according to the bandgap principle, having a first reference transistor (23) and a second reference transistor (24), which are connected parallel to one another in order to divide a current into two current paths, and each of which has an emitter electrode, a collector electrode and a base electrode, wherein the base electrodes, of said first and second reference transistors (23, 24), are connected to one another and to an output terminal (18), at which the reference voltage is picked up, and wherein further a series circuit of a first resistor (21) and a second resistor (22) leads from a supply potential (15) to the emitter electrode of the second reference transistor (24), and the emitter electrode of the first reference transistor (23) is connected to a node point between the first (21) and second (22) resistors, wherein to compensate for the higher order temperature coefficient remaining in two reference transistors (23, 24) operated with differing current density, the two resistors (21, 22) are at least partly formed by zones having a differing temperature coefficient, and the quadratic term of the temperature coefficient of the first resistor (21) is greater than the quadratic term of an average temperature coefficient of the second resistor (22);

the second resistor (22) is split into a series circuit of a first subresistor (32) and a second subresistor (42, the first subresistor (32) and the first resistor (21) both forming part of a common base diffusion zone, and the second subresistor (42), serving as a compensation resistor, forming part of an emitter diffusion zone, having a smaller quadratic term in its temperature coefficient than said first resistor (21) has.

2. The precision reference voltage source of claim 1, wherein the difference, between the quadratic terms of the temperature coefficients $\beta_{21}$ of the first resistor (21) and $\beta_{22}$ of the second resistor (22) resulting from the sum of the subresistors (32, 42), is in the range of $0.3 \cdot 10^{-6} \leqq \beta_{21} - \beta_{22} \leqq 1.2 \cdot 10^{-6}$.

3. The precision reference voltage source of claim 1, wherein when the second resistor (22) is produced by means of a zone having a smaller quadratic term, the first resistor (21) is split into a series circuit comprising a third subresistor (31) and a fourth subresistor (41), the third subresistor (31) being formed by the same zone as the second resistor (22), and the fourth subresistor (41), serving as a compensation resistor, being formed by means of a zone having a greater quadratic term.

4. The precision reference voltage source of claim 3, characterized in that when the first resistor (21) is represented by means of a zone having a greater quadratic term of the temperature coefficient, the second resistor (22) is split into the series circuit of a first subresistor (32) and a second subresistor (42, the first subresistor (32) being embodied by means of the same zone as the first resistor (21), and the second subresistor (42), serving as a compensation resistor, being embodied by means of a zone having a smaller quadratic term (FIG. 5).

5. The precision reference voltage source of claim 3, wherein the second resistor (22) and the third subresistor (31) are produced by means of the emitter diffusion zone, and the fourth subresistor (41), serving as a compensation resistor, is represented by means of the base diffusion zone.

6. The precision reference voltage source of claim 1, wherein the reference voltage, which may deviate from a predetermined command value as a result of unavoidable production deviations, is subsequently calibrated to the desired or command value.

7. The precision reference voltage source of claim 6, wherein said calibration is performed by varying at least one of two subresistors (41 or 42) serving as compensation resistors.

8. The precision reference voltage source of claim 1, further comprising a first current mirror transistor (25) and a second current mirror transistor (26), which serve to impress currents into the current paths of the two reference transistors (23, 24), wherein said two current mirror transistors (25, 26) are formed as PNP lateral transistors, their collectors are halved in their circumference, and the halves are each connected crosswise to one another.

9. The precision reference voltage source of claim 1, wherein said reference transistors (23, 24) are formed as NPN transistors, and the at least two identical subtransistors of the second reference transistor (24) are disposed symmetrically with respect to the first reference transistor (23).

10. The precision reference voltage source of claim 9, wherein said second reference transistor (24) is formed by at least four identical subtransistors.

11. The precision reference voltage source of claim 1, wherein a third order term is also taken into account for the correction of the higher order temperature coefficient remaining in the two reference transistors (23, 24) operated with differing current density.

12. The precision reference voltage source of claim 3, wherein a temperature coefficient of at least one subresistor of the resistor combinations (21 and 22; 31, 42 and 22; or 21, 32 and 42) is variable by varying its width in the design.

* * * * *